United States Patent [19]

Woodson

[11] 4,348,774

[45] Sep. 14, 1982

[54] WEIGHT LIFTER'S BELT

[75] Inventor: Thomas W. Woodson, Knoxville, Tenn.

[73] Assignee: The Christian Leather Company, Inc., Knoxville, Tenn.

[21] Appl. No.: 170,171

[22] Filed: Jul. 18, 1980

[51] Int. Cl.[3] ..... A41F 9/00

[52] U.S. Cl. ..... 2/338; 128/78; 128/95

[58] Field of Search ..... 2/338, 321, 336, 340, 2/322; 128/75, 78, 99, 95, 96; D2/380

[56] References Cited

U.S. PATENT DOCUMENTS

| | | | |
|---|---|---|---|
| D. 33,621 | 11/1900 | Wasserstrom | D2/380 |
| D. 109,092 | 3/1938 | Medearis | D2/380 |
| 3,052,236 | 9/1962 | Schrieber | 128/78 |
| 3,090,048 | 5/1963 | Loew | 2/338 |
| 3,096,760 | 7/1963 | Nelkin | 128/95 |
| 3,154,072 | 10/1964 | Mack | 128/78 |
| 3,171,409 | 3/1965 | Cetrone | 128/99 |
| 3,530,031 | 9/1970 | Loew | 2/338 X |
| 3,561,434 | 2/1971 | Kilbey | 128/75 |

*Primary Examiner*—H. Hampton Hunter
*Attorney, Agent, or Firm*—Luedeka & Fitch

[57] ABSTRACT

A weight lifter's belt fabricated from leather which is lined with a thin layer of foamed flexible plastic having a Shore A Durometer hardness of between about 10 and 25, the liner being attached to the inner surface of the belt by a flexible adhesive. The liner, as outlined above, provides added comfort to the wearer and effects heat retention in the back and back muscles of the wearer and enhances blood circulation in the lower back to improve lifting performances.

4 Claims, 4 Drawing Figures

WEIGHT LIFTER'S BELT

The present invention relates generally to belts employed by weight lifters and, more particularly, to the provision of an improved weight lifter's belt which is comfortable in use, which is durable, and which provides for retention of body heat to condition the muscles in the back of the wearer.

Weight lifters employ belts in weight lifting activities to aid in supporting the spine and back muscles. The usual belt includes a wide panel which extends across the back and around the flanks of the user, the width of this panel being about 4 inches or more.

The belt is usually made of relatively stiff leather and has a thickness of the order of about $\frac{1}{4}$ inch. The conventional belts have several deficiencies. First, they are not comfortable. Because of the stiffness of the leather, the edges of the belt tend to cut into the skin of the wearer, especially when the belt is cinched tightly around the wearer. Second, the perspiration of the wearer causes the leather to deteriorate and emit odors. In addition, a leather belt does not retain body heat in the area covered by the belt to the extent desired. It has been found that the degree of heat retention affects the performance of the user and greater heat retention results in improved lifting ability provided that such heat retention does not result in other problems such as excessive perspiration, discomfort or the like.

Accordingly, it is the principal object of this invention to provide an improved belt of the class described. Other objects and advantages of the invention will become known from the following description and accompanying drawings in which.

Figure 1:
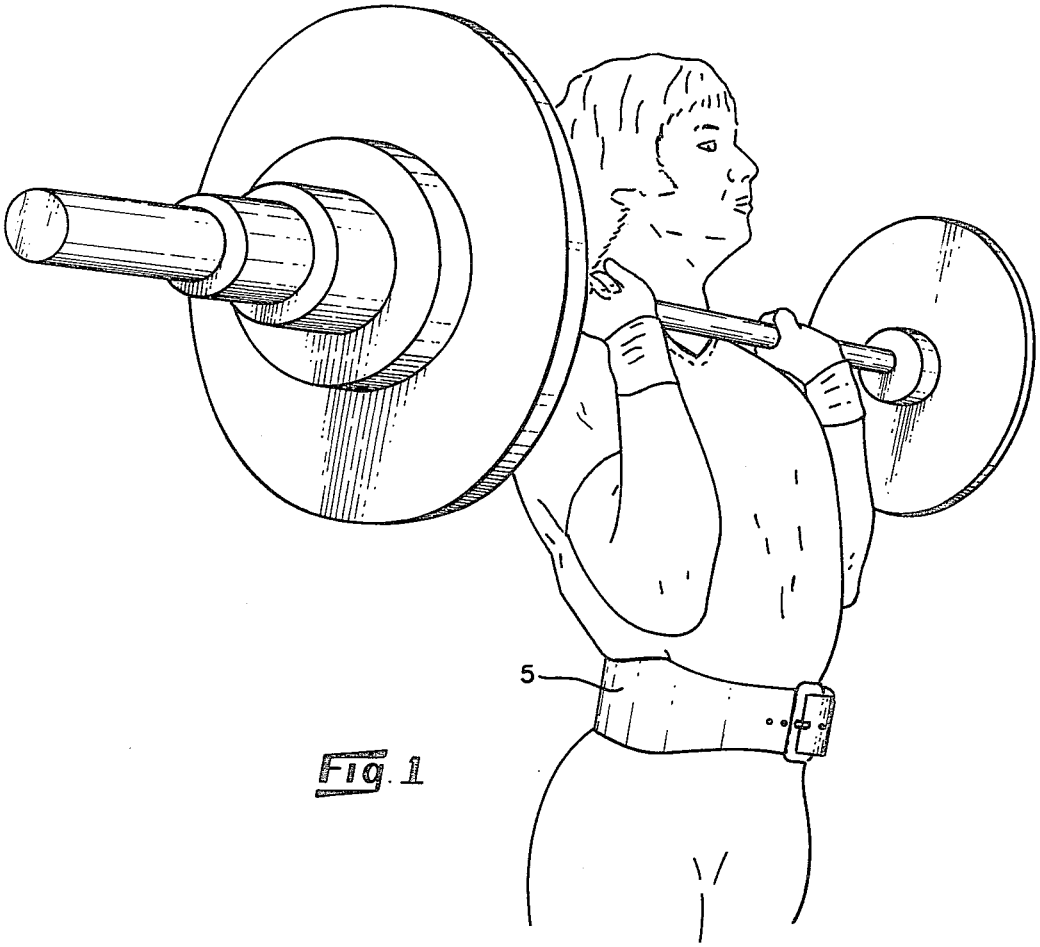
FIG. 1 is a perspective view of a weight lifter employing a weight lifting belt.

As illustrated in the drawings, the weight lifting belt of this invention is basically a conventional weight lifting belt which is provided with an inner liner having certain defined characteristics. The belt 5 is fabricated from a strip of leather having a thickness of about $\frac{1}{4}$ inch which is sufficiently long to encircle the body of the wearer. The belt 5 includes a wide panel 7 which, as pointed out above, is about 4 inches or more in width and is long enough to extend across the back and around the flanks of the wearer. At one end of panel 7 the belt is tapered to a width of about $2\frac{1}{2}$ inches to provide a belt tongue 9 which is provided with spaced openings 10. At the other end of panel 7 the belt is also tapered to a width of about $2\frac{1}{2}$ inches to provide a panel or tongue 11 for connection with a buckle 13. The buckle 13 includes the usual buckle ring 15 and buckle tongue 17. The buckle ring 15 and tongue 17 are attached to the panel 11 in the usual manner by folding the panel 11 around the buckle ring 15, as shown at 19 in FIG. 3, the folded over portion being secured by rivets 21 or the like to the belt 5. A keeper loop 23 of leather or the like in which any excessive portion of the belt tongue 9 may be passed to maintain it out of the way is also held by the folded over portion 19 of the belt. As is the usual case, the hide side of the belt is on the outside and the flesh side of the leather is on the inner surface.

In order to improve the properties and performance of the belt, the inner surface of the belt in the area between the openings 10 on the belt tongue 9 and the buckle is provided with a layer 25 of a foamed flexible plastic which is attached to the inner surface of the belt by a flexible adhesive such as a silicon adhesive, a latex adhesive or the like.

The foamed layer on liner 25 is preferably of uniform cross section and has a thickness less than the thickness of the leather of the belt. Consequently, the properties of the belt in terms of support does not vary materially from that of a conventional leather weight lifter's belt.

The flexible plastic of the liner may be either open celled or closed celled. However, it is preferred that the flexible plastic liner be of open cell construction, i.e. the cells in the foam are in large part interconnected.

While various foam plastic materials may be employed, best results have been obtained by employing a foamed flexible polyurethane liner of open cell construction, the plastic having a Shore A Durometer hardness of from about 10 to about 25, and preferably about 18. The liner had a thickness of about $\frac{1}{8}$ of an inch. For purpose of comparison, the usual hardness of the leather in a weight lifter's belt is in the range of approximately 60–65 Shore A Durometer. A suitable liner material is sold by Rodgers Corporation, East Woodstock, Conn., under the trademark "PORON."

It is also desirable that means be provided to prevent perspiration from penetrating the liner and migrating into the leather of the belt. This can be accomplished by employing a foamed, open celled plastic having a closed cell skin which is formed when the plastic is cast or extruded. In use, the closed cell skin is disposed adjacent the adhesive which bonds the liner to the leather. In the alternative, assuming that the open celled liner is formed without a closed celled skin, a moisture barrier can be provided by a layer of the silicon or latex adhesive which is employed to bond the liner to the leather.

Figures 2, 3, 4:
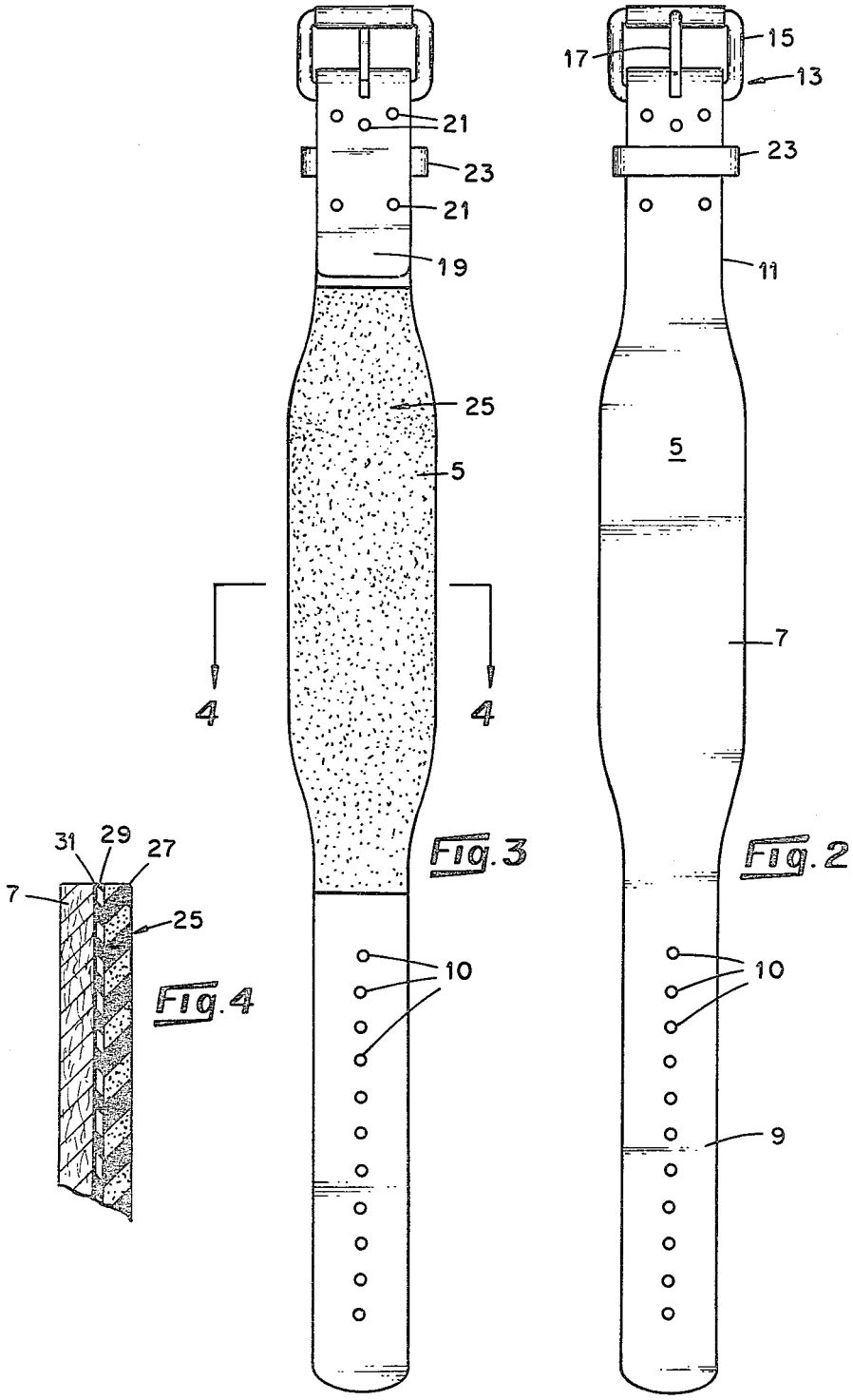
FIG. 2 is a plan view of the outer side of a weight lifters belt embodying various of the features of this invention.
FIG. 3 is a plan view of the inner side of the belt shown in FIG. 2.
FIG. 4 is a fragmentary sectional view taken on line 4—4 in FIG. 3.

As shown in the drawings, and particularly FIG. 4, the plastic liner 25 includes an open cell area 27, a closed cell skin 29 which is attached to the inner face of the leather by a flexible adhesive 31 which in the illustrated structure is a latex cement.

In use, a belt as described above, provides comfort for the wearer in that the thin layer of flexible plastic protects the user from the sharp edges of the leather belt as it is cinched about his waist. It has also been found that the open cell construction in contact with the wearer's skin provides a comfortable feel and sufficient circulation of and capacity for absorbing moisture that comfort problems due to perspiration are minimized. Also, it has been unexpectedly found that with the use of the liner, the heat retention in the back and back muscles of the wearer is optimized and blood circulation in the lower back is improved so that improved lifting performances are possible. After use, the interior surface of the belt can be sponged with water or the like, and any perspiration or the like which gathers in the connected openings in the plastic may be removed, giving the product long life, and insuring cleanliness. The closed cell skin 29 or the flexible adhesive 31 prevents moisture from attacking the leather and the flexible bond accommodates repeated flexing without delamination.

While it is possible to employ a closed cell liner, it has been found that the moisture retaining capacity of the open cell film results in a highly superior feel, a minization of localized perspiration and optimum heat retention.

While a preferred embodiment has been shown and described, it will be understood that there is no intent to limit the invention by such disclosure, but rather, it is intended to cover all modifications and alternate constructions falling within the spirit and scope of the invention as defined in the appended claims.

What is claimed:

1. In a weight lifting belt fabricated from leather having a relatively wide portion to cover the back and flanks of the wearer and having means to cinch the belt around the wearer, the improvement which comprises providing a liner which extends across the entire inner surface of the belt in the area of the back and flanks of the wearer, said liner being of a thickness less than the thickness of the leather belt, said liner being fabricated from a foamed flexible plastic having a Shore A Durometer hardness of between about 10 and 25 and the liner being attached to the inner surface of said belt by a flexible adhesive.

2. The belt of claim 1 wherein the liner is of uniform thickness and the flexible plastic is open celled.

3. The belt of claim 2 wherein the liner has a closed cell skin on one side thereof, said closed cell skin being disposed adjacent to the inner surface of said belt and being attached thereto.

4. The belt of claim 2 wherein the liner is fabricated from polyurethane and has a Shore A Durometer hardness of about 18 and is of the order of $\frac{1}{8}$ inch in thickness.

* * * * *